United States Patent [19]

Croft et al.

[11] 4,148,600

[45] Apr. 10, 1979

[54] HEAT TREATMENT FURNACE FOR METAL STRIP

[75] Inventors: Edward F. B. Croft, Aldridge; John J. Lane, Weston-Super-Mare, both of England

[73] Assignee: British Steel Corporation, London, United Kingdom

[21] Appl. No.: 813,956

[22] Filed: Jul. 8, 1977

Related U.S. Application Data

[62] Division of Ser. No. 711,236, Aug. 3, 1976, Pat. No. 4,065,251.

[51] Int. Cl.[2] ..... F27B 9/28

[52] U.S. Cl. ..... 432/8; 432/59; 34/155; 266/111; 266/251

[58] Field of Search ..... 432/8, 58, 59, 21, 143, 432/144, 152, 176, 185, 199, 230, 145; 34/155, 156, 233, 225, 86; 266/111, 251; 431/115, 116

[56] References Cited

U.S. PATENT DOCUMENTS

| | | | |
|---|---|---|---|
| 982,665 | 1/1911 | Gantvoort | 432/144 |
| 1,948,173 | 2/1934 | Hagen | 432/58 |
| 2,136,993 | 11/1938 | Palmgren | 34/233 |
| 2,181,928 | 12/1939 | Vaughan | 432/145 |
| 2,214,157 | 9/1940 | Bannister | 432/8 |
| 2,750,680 | 6/1956 | Hondry et al. | 34/86 |
| 2,795,054 | 6/1957 | Bowen | 432/8 |
| 3,100,632 | 8/1963 | Mohring | 432/145 |
| 3,513,813 | 5/1970 | Towson et al. | 431/116 |
| 3,522,936 | 8/1970 | Greipel et al. | 432/59 |
| 3,550,922 | 12/1970 | Geipel | 432/58 |
| 3,604,824 | 9/1971 | Handison | 34/155 |
| 3,614,074 | 10/1971 | Wellford, Jr. | 432/176 |
| 3,997,317 | 12/1976 | Dicks | 432/145 |
| 4,028,052 | 6/1977 | Verhoeven et al. | 432/145 |
| 4,059,399 | 11/1977 | Cellier et al. | 432/145 |

*Primary Examiner*—Henry C. Yuen
*Attorney, Agent, or Firm*—Bacon & Thomas

[57] ABSTRACT

A process for heating one or more bodies in a furnace in which heated gas is introduced into the furnace chamber through one or more injectors and are conveyed to the bodies in a manner involving appreciable resistance to gas flow to generate an air cushion for supporting the bodies. In a preferred arrangement a continuous metal strip is conveyed through the furnace on a gaseous support cushion, the gas being introduced into the furnace under pressure through injectors which communicate with the lower portion of the furnace. The injectors and the furnace internal wall structure generate a substantial recirculation of gas within the furnace.

3 Claims, 7 Drawing Figures

Figure 1:
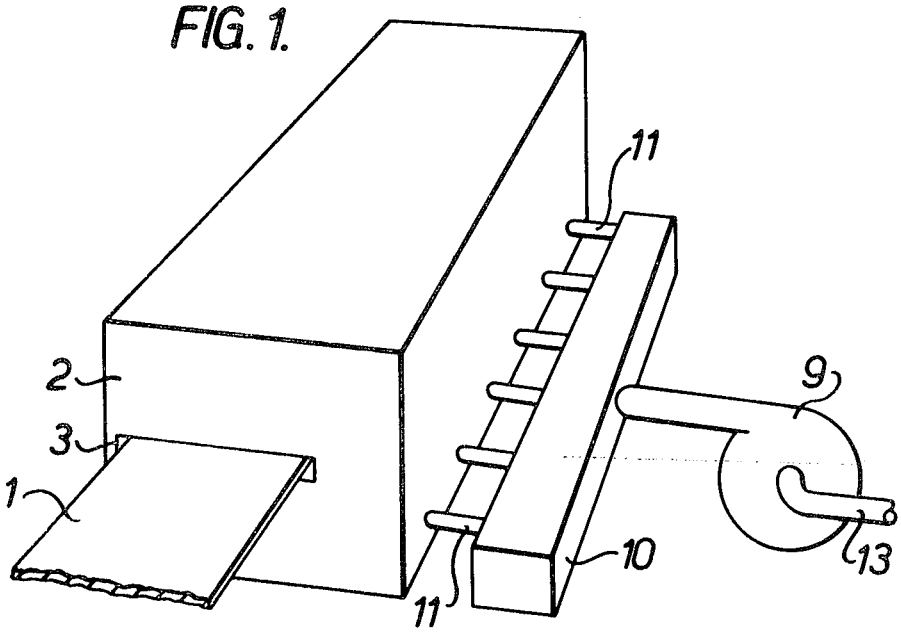

FIG. 3.
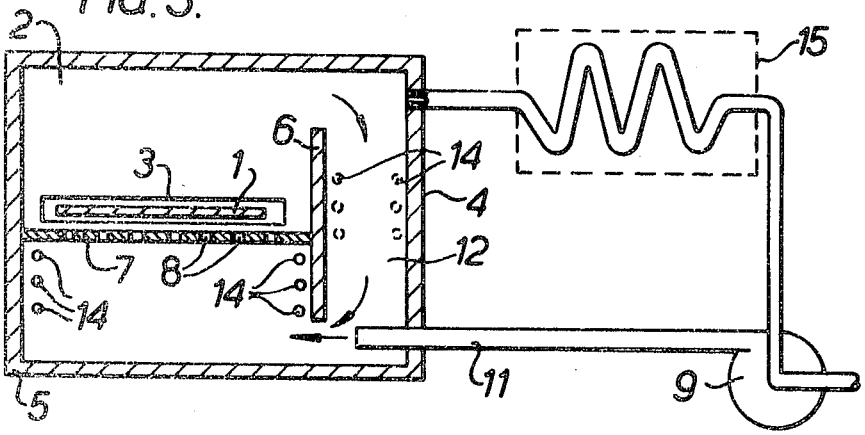
FIG. 4.
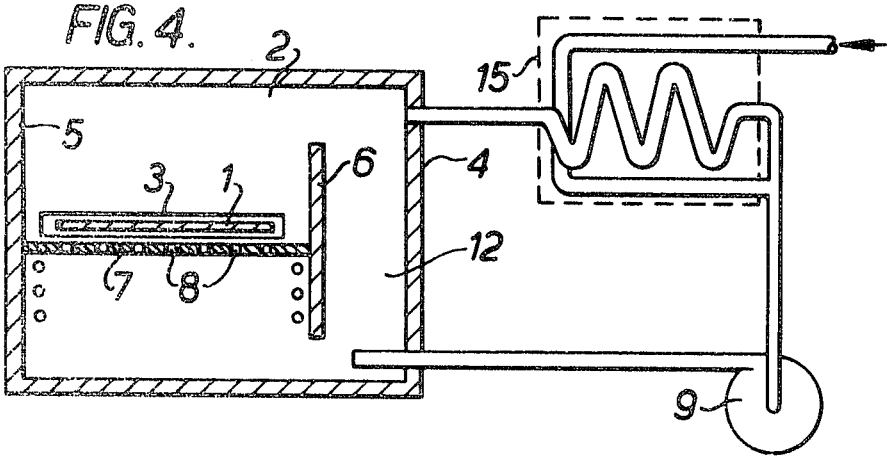
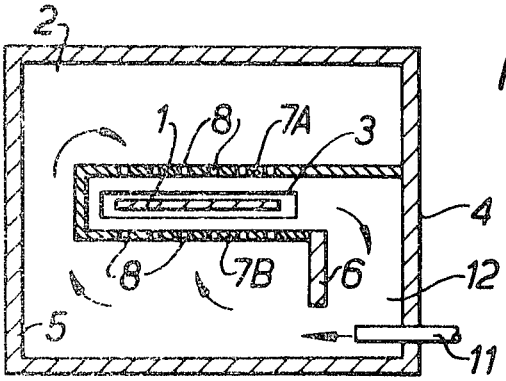
FIG. 5.

HEAT TREATMENT FURNACE FOR METAL STRIP

This is a division of application Ser. No. 711,236, filed Aug. 3, 1976 now U.S. Pat. No. 4065,251.

This invention relates to furnaces of the kind in which a stream of heated gas (which term also includes gas mixtures) is arranged to be directed over a body or bodies required to be heated or to be maintained at a predetermined temperature, and is especially, though not exclusively, concerned with furnaces of this kind designed for heating strip or sheet material, hereinafter referred to simply as strip.

Where the body or bodies are required to be heated to a high temperature, involving a large volume flow of the gas, thermal losses may be considerable, and whilst recirculation of the gas may in some cases provide a way of reducing such thermal losses to some extent, practical difficulties have previously limited the usefulness of this technique. Thus for some applications the gas may have to negotiate restricted passages providing an appreciable resistance to gas flow, and high power blowers, compressors, or the like devices may therefore be needed to impart sufficient pressure energy into the system in order to obtain the required circulation. However there is a limit to the temperature at which such devices as are currently available can operate satisfactorily at least for prolonged periods.

According to the present invention in one aspect, a furnace in which a stream of heated gas is arranged to be directed over a body or bodies to be heated or maintained at a predetermined temperature comprises a chamber arranged to accommodate the said body or bodies in a manner involving appreciable resistance to gas flow, injector means for feeding gas under pressure into the chamber so that it passes over the body or bodies, and means for heating the gas, the injector means being so constructed and arranged as to cause a substantial proportion of the gas, after passing over the body or bodies, to be recirculated through the chamber.

Such an arrangement has the advantage that the pressure eneergy required for producing a rapid circulation of the gas is imparted to the gas within the furnace without the need for a blower, compressor, or other device, hereinafter referred to simply as blower means, being located in the recirculating-flow circuit, so that the blower means can be operated at a temperature which is lower than that of the gas circulated within the furnace chamber, it being found that the energy level of the gas injected into the furnace chamber can readily be arranged to produce a circulation of gas around the recirculating-flow circuit of between two and six times its own weight. At the same time the recirculation of gas within the furnace has the effect of reducing thermal losses, which could be considerable if the gas, after passing over the body or bodies, were allowed to escape freely to the atmosphere.

It is, of course, not possible to avoid a certain amount of gas escaping from the furnace, and an additional quantity of fresh gas is conveniently admitted to the blower means in order to make up the losses which are incurred.

Preferably the furnace incorporates one or more internal passages for returning gas which has passed through the furnace chamber to the vicinity of the injector means, for recirculation through the furnace chamber.

The gas may be heated externally of the furnace and/or by means of over the located within the furnace. The principal source of heat to the body or bodies may comprise the recirculated gas; the heating capacity of the gas may be supplemented by direct radiation from, for example, electrical resistance heating elements or gas fired radiant tubes mounted on the furnace walls. Alternatively, the principal heat energy source to the body or bodies may be provided by heaters such as electrical resistance heating elements located within the furnace chamber.

In some cases a proportion of the gas after it has been passed overthe body or bodies may be recirculated to the blower means, and where the temperature of the heated gas exceeds that with which the said blower means can deal satisfactorily, means, such as a heat exchanger, may be provided for cooling the gas after it has left the chamber.

Means may, in some cases, be provided for varying the proportions of re-circulated and fresh gas fed into the chamber.

For some purposes heat extracted from the gas may be used to heat up the fresh gas used to make up losses from the system before it is admitted to the blower means, thereby reducing still further the thermal losses from the system.

In some cases, however, the recirculated and fresh gas may be allowed to mix directly in appropriate proportions before being admitted to the blower means, so as to reduce the temperature of the former to a value at which the blower means can operate satisfactorily, without any additional cooling means being required.

The invention has application, for example, to furnaces in which the body or bodies are accommodated in the chamber so that the gas can be directed on to the surface of the body or bodies in the form of a multiplicity of jets having appreciable resistance to gas flow. Such furnaces are employed for the jet heating of bodies in the form of sheet or strip material where the jets are obtained, for example, by forcing the gas under pressure through a suitably apertured plate, commonly known as a jet plate, so that pressure energy needs to be imparted to the gas stream to compensate for losses in the circuit which are particularly high across the jet plates, and possibly across any heater or heat-exchange means used for providing the thermal energy.

However, the invention also has application to furnaces in which the bodies are accommodated in the chamber in baskets or trays in a manner involving appreciable resistance to gas flow, so that high pressure energy is required to force the recirculating gas stream through or between the bodies in order to provide a high and uniform level of heat transfer.

For the heat treatment of metal strip in particular the furnace will be of considerably length in order to ensure adequate heating of the strip during its passage through the furnace chamber, and in such a case gas is preferably injected into the chamber through a plurality of injector means spaced apart along the furnace. A single blower means may be common to all the injector means, although a number of blowers each supplying gas to one or more injector means may be employed.

Where the furnace is used for heating metal or other strip with the strip arranged to be fed through the furnace chamber substantially horizontally or down a slight incline, the injector means may be arranged to feed the said gas under pressure into the lower part of the chamber so that it passes upwards through the chamber and provides a cushion of gas which acts as a support for the strip on its passage through the chamber.

Thus according to the present invention in another aspect, a furnace for the continuous heat treatment of metal strip, in which the strip is supported on a gaseous cushion as it travels through the furnace, comprises a furnace chamber including a lengthwise-extending strip support surface, injector means for feeding gas under pressure into the furnace chamber so as to promote rapid recirculation of at least a major proportion of the gas contained in the furnace chamber and means for directing recirculating gas over the strip support surface to provide a gaseous cushion between said support surface and metal strip travelling through the furnace.

Preferably, the gas introduce into the furnace is dense to minimise the volume required to support the strip. Light gases such as hydrogen can be employed that would entail the use of large gas volumes. Additionally, the gas may be selected to provide a protective or reducing atmosphere within the furnace chamber. In one example the gas comprises a mixture of argon and hydrogen and in another a mixture of nitrogen and hydrogen.

The furnace chamber may include a plurality of transverse baffles which divide the lower part of the chamber into a number of compartments, into each of which is fed gas under pressure; the rate of flow of gas into each compartment may be controlled independently of the rate of flow into the other compartments thereby enabling the degree of floatation of the strip at any region of the furnace to be adjusted as desired.

This is of advantage, for example, during the threading of strip through the furnace, or when a change of strip thickness is passed through it, as well as when local difficulties are experienced with floataton for reasons of strip, furnace or gas flow deterioration.

In some cases, different gases or gases at different temperatures may be fed into the furnace either through the same or different injector means, and with such an arrangement the rates of flow may be controlled, for example, so as to produce a variation in the proportions of the constituents at different parts of the furnace or on a time basis.

A number of furnaces in accordance with the invention will now be described by way of example with reference to FIGS. 1 to 7 of the accompanying schematic drawings, in which:-

Figure 2:
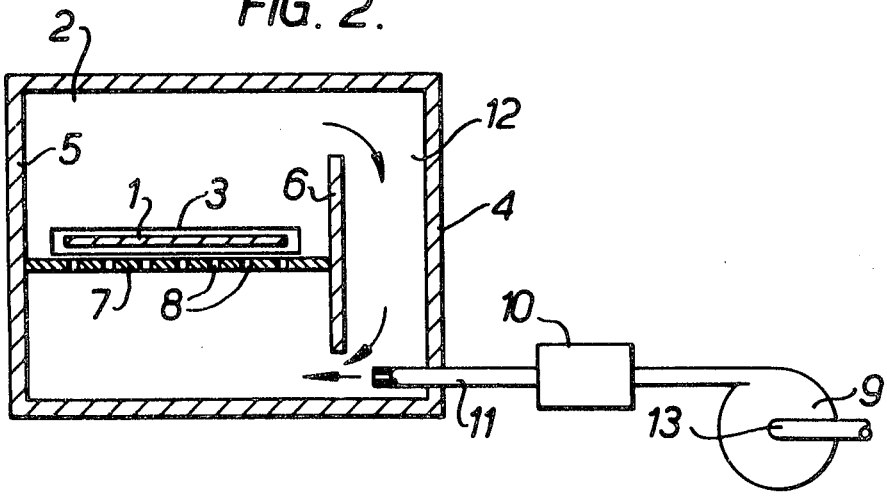
Figure 6:
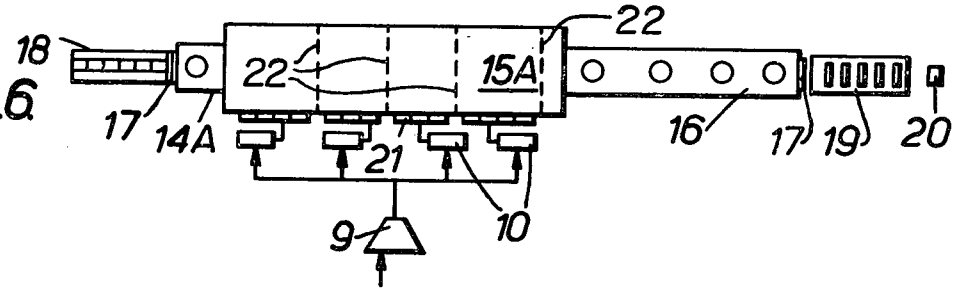
Figure 7:
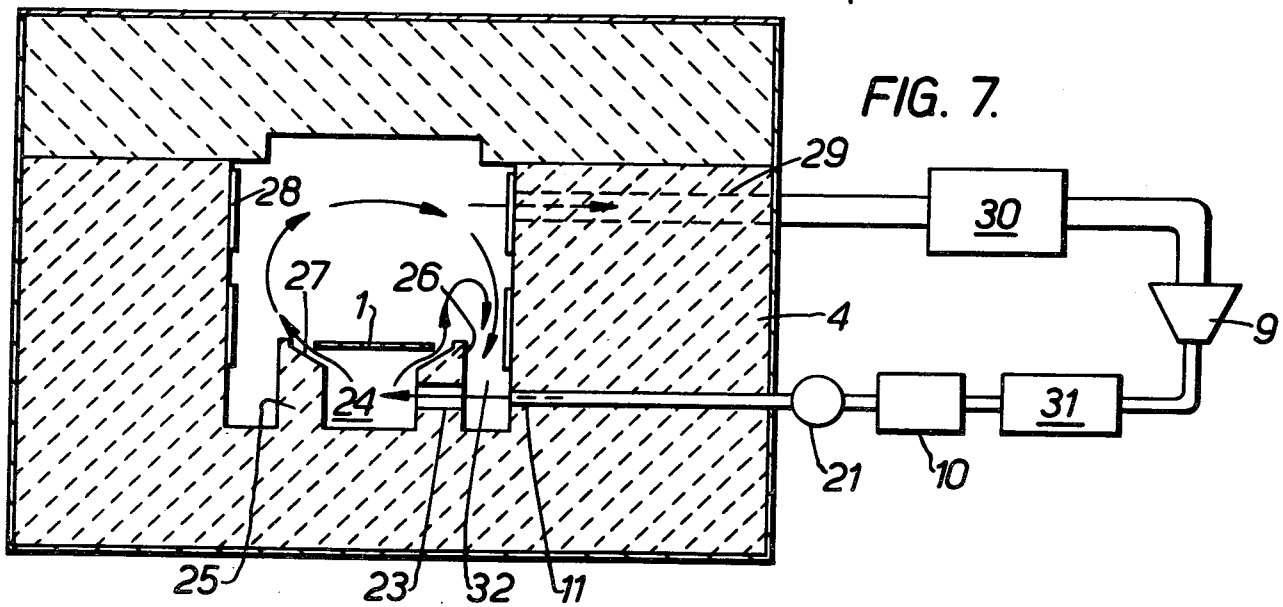

FIGS. 1 and 2 illustrate in diagrammatic form a perspective view and a transverse cross-section through the first furnace, FIG. 3 illustrates, also in diagrammatic form, a transverse section through the second furnace, FIG. 4 shows a modified form of the furnace illustrated in FIG. 3, FIG. 5 illustrates a transverse section through a further form of furnace, and FIGS. 6 and 7 are respectively a plan and a transverse section through a still further form of furnace.

Referring first to FIGS. 1 and 2, the furnace illustrated therein is designed to heat a continuously moving metal strip 1 and comprises an elongated chamber 2 through which the strip is fed substantially horizontally, the furnace being closed apart from narrow horizontal slots 3 at its two ends for the passage of the strip into and from the chamber.

Between the two side walls 4,5 of the furnace there is located an internal wall 6 which extends the length of the furnace adjacent the wall 4, the internal wall 6 and the other side wall 5 defining the furnace chamber and supporting between them a horizontal plate 7 formed with a multiplicity of openings 8, the plate being slightly lower than the slot 3 as shown in FIG. 2.

The strip is designed to be heated by a gas, or gas mixture fed into chamber by a suitable blower 9, means of any convenient kind being provided for heating the gas to an appropriate temperature, either between the blower and the chamber as shown at 10 or alternatively after its entry into the chamber.

The gas is arranged to be introduced into the lower part of the furnace under pressure through a plurality of injectors 11 spaced along the side 4 of the furnace so that they direct the gas into the furnace chamber between the walls 5,6, the pressure of the gas being such that it is forced upwards through the openings 8 in the plate 7 which cause it to be directed in the form of jets on to the lower surface of the strip 1.

In addition the rate at which gas is injected into the furnace produces a pressure drop in the vicinity of the injectors 11 sufficient to cause gas, after heating the strip 1, to be recirculated at a high rate from the upper to the lower part of the chamber through the passage 12 provided between the internal wall 6 and the adjacent side wall 4. By causing gas to be circulated within the furnace in this manner thermal losses can be considerably reduced, and the need for locating the blower in the recirculating flow path is avoided.

Some gas will escape from the ends of the furnace, and losses are made up by fresh gas fed to the blower 9 through inlet 13.

In the second furnace illustrated in FIG. 3 the external heating means 10 is replaced by internal heaters, for example electrical resistance heating elements 14, conveniently fitted to the furnace walls 5,6 beneath the plate 7. In addition part of the gas from the upper part of the furnace chamber 2 is recirculated through the blower 9 thereby reducing the quantity of fresh and unheated makeup gas required.

Since the temperature of the gas stream leaving the chamber 2 will normally be higher than that which can be reliably withstood by conventional forms of blowers a heat exchanger 15 is provided for cooling the gas between the chamber 2 and the blower 9.

Means (not shown) may be provided for varying the proportions of the recirculated and fresh gas fed into the furnace through the injectors 11.

Electric heating elements may additionally or alternatively be placed in the passage 12 as shown at 14. Other forms of heating can alternatively be employed, for example gas burners located within the lower part of the furnace chamber.

In the modification of this second furnace which is illustrated in FIG. 4 the heat exchanger 15 is used to raise the temperature of the fresh make-up gas before it is admitted to the blower 9, thereby reducing still further the thermal losses of the system.

In some cases it may be possible to dispense with the heat exchanger completely, fresh gas at a suitably low termperature being mixed with the recirculated gas in suitable proportions in order to cool it before it is returned to the blower.

Whilst, in the furnaces illustrated, the strip 1 is arranged to be fed through the furnace horizontally it may alternatively be fed through the furnace in a vertical or inclined plane, the furnace including the positioning of the injectors 11 being modified accordingly.

However, in cases where the strip is arranged to be fed horizontally or down a slight incline the pressure of the gas injected into the furnace may be such that in addition to heating the strip it also provides a cushion of pressurised gas which supports the strip on its passage through the furnace.

In such a case the lower part of the chamber of a furnace as shown in any of FIGS. 1 to 4 may be split into several compartments by a number of transverse vertical walls, (not shown), spaced apart a distance of the order of two or three feet, with their upper edges terminating just below the level of the slots 3, each of the compartments being associated with an individual injector 11. Such an arrangement prevents local floatation being seriously affected by a different situation existing elsewhere in the furnace, and allows the flow through a particular region to be adjusted, for example by controlling the flow of gas through a respective injector 11, or by throttling the appropriate region of the return duct 12 which can be divided into a number of separate sections by means of transverse walls (not shown).

In some cases, heated gas may be required to be directed in the form of jets on to both surfaces of the strip 1, and a furnace for achieving this is shown schematically in FIG. 5.

In this furnace the furnace chamber 2 accommodates a pair of horizontal jet plates 7A and 7B located above and below the slots 3, and so arranged that the heated gas from the injectors 11 is directed on to the upper and lower surfaces of the plates through the holes 8 in the plates 7A and 7B respectively, the rate at which gas is fed into the furnace through the injectors producing a recirculation of the gas from between the plates back into the main part of the furnace through the passage 12, where it is redirected on to the strip through the holes in the jet plates, in a manner similar to that of the furnaces illustrated in FIGS. 1 to 4.

The furnace illustrated in FIGS. 6 and 7 is again designed to heat a continuously moving metal strip 1 and comprises an elongate chamber 2 through which the strip is fed in a substantially horizontal or slightly downwardly inclined direction. More particularly, the furnace includes a water cooled entry zone 14A, a heating zone 15A and an exit cooling zone 16. Pressure seals 17 are provided at the entrance to and exit from the furnace in order to minimise gas losses to the atmosphere. Strip is fed to the furnace along a floatation table 18 and is withdrawn from the furnace over a roller table 19 by means of a pair of pinch rolls 20.

As described with reference to the previous embodiments, gas under pressure is fed into the heating zone 15A through the injectors 11, the gas being compressed in the blower 9 and fed via the heaters 10 to manifolds 21 in communication with the individual injectors.

The lower part of the heating zone 15A is split into several compartments by a plurality of spaced transverse vertical walls 22. The upper edges of the walls 22 terminate just below the level of the entry and exit ports of the furnace and each compartment is supplied with gas under pressure through an individual injector 11 or through a batch of injectors. This arrangement prevents local floatation being seriously affected by a different situation existing elsewhere in the furnace, and allows the flow through a particular region to be adjusted, for example by controlling the flow of gas through a respective injector 11.

As illustrated in FIG. 7 each injector 11 extends through one refractory lined side wall 4 of the furnace to discharge gas under pressure through an opening 23 formed in the furnace hearth into a plenum chamber 24. The hearth includes two vertical walls 25, 26 provided at their upper ends with outwardly inclined lips 27 running horizontally along the full length of the furnace.

Electrical heating elements 28 are mounted on the side walls of the furnace chamber. Ducting 29 is provided in the upper portion of the side wall 4 to convey gas from the furnace chamber to an external gas circulation circuit which includes a cooler 30, the blower 9, a dryer 31, heaters 10 and injector manifolds 21. Gas under pessure is fed from the manifolds 21 to the injectors 11.

In operation of the furnaces illustrated in FIGS. 6 and 7 metal strip is admitted to the furnace through the entry seal 17 and is supported on its passage through the furnace chamber above the lips 27 on cushions of gas supplied from the plenum chamber 24. In turn the plenum chamber is supplied with gas under pressure from the injectors 11. The gas jets issuing from the injectors 11 induce gas already present in the furnace to flow through the passage 23 into the plenum chambers 24. As indicated by arrows in FIG. 7, the gas from the plenum chamber 24 passes between the opposed surfaces of the lips 27 and the strip 1 and is caused to recirculate via a side passage 32 back to the vicinity of the injectors 11 to be returned to the plenum chamber 24.

A portion of the recirculating gas is withdrawn from the furnace through the ducting 29, is cooled and then compressed, dried and heated before being returned to the furnace by the injector manifolds 21.

In treatments in which the mass of gas required to provide the heat to raise the strip to the required temperature and at the same time to support the strip during its passage through the furnace are mutually compatible, no additional heat source other than the heat energy contained in the gas will be required. Thus, in the furnace illustrated, the entire heat energy input to the gas may be derived from the heaters 10 the heater elements 28 either being removed or switched off. In other treatments however, where the throughput of strip through the furnace is large and/or when the desired strip temperature is in excess of the gas temperature, additional sources of heat are required. In these cases, the electrical resistance heating elements 28 or gas fired radiant tubes located within the furnace chamber provide direct radiation heating to the strip. This situation arises when sintering strip made by roll compaction of metal powders, where the desired tempratures may in the case of stainless steels fall within the range 1000°to 1400° C.

It will be appreciated that use of the injectors 11 promotes rapid recirculation of the gases within the furnace to provide the large volume of gas required to support and heat the strip within the furnace both economically and practicably. These criteria are of particular importance when the nature of the strip being heat treated requires a furnace atmosphere which is relatively expensive. For example, stainless steel strip made by roll compacting stainless steel powder can advantageously be sintered in atmospheres composed of mixtures of argon and hydrogen by employing injectors to feed the support gas into the lower part of the furnace chamber, the mass of gas delivered to the plenum chamber 24 being increased by virtue of the induced internal recirculation by a factor of between 2:1 and 6:1 compared with the mass of gas fed to the injectors. Further significant economies are achieved by recirculating a proportion of the gas after it has passed over the strip externally of the furnace to the blower compressor 9 for re-injection to the furnace.

We claim:

1. In a method for the continuous heat treatment of metal strip which comprises the steps of feeding metal strip continually to the entrance of a furnace chamber of a heat treatment furnace and transporting the metal strip through the furnace on a gaseous cushion above a lenthwise extending strip support surface, the improvement which comprises injecting into the furnace chamber gas under pressure from a source located externally of the furnace chamber thereby to place its interior under pressure; permitting a portion of the gas to escape from the furnace; promoting by entrainment with the injected gas internal recirculation of the remainder of the gas along a flow path defined by internal wall structure of the furnace chamber, and directing said circulating gas over the strip support surface of the furnace chamber to provide the aforesaid gaseous cushion between said surface and metal strip travelling through furnace.

2. A method of heat treating metal strip as claimed in claim 1 further comprising the steps of withdrawing from the furnace a minor proportion of the gas recirculating within the furnace chamber, raising its pressure and reintroducing the gas into the furnace chamber to promote the aforesaid internal recirculating gas flow within the furnace chamber.

3. A method of heat treating metal strip as claimed in clim 2 further comprising the step of adding a quantity of fresh gas to the gas withdrawn from the furnace to make up for gas escaping from the furnace.

* * * * *